United States Patent [19]

Perry

[11] Patent Number: 4,538,776

[45] Date of Patent: Sep. 3, 1985

[54] CREEL APPARATUS

[75] Inventor: T. Cooper Perry, Roanoke, Ala.

[73] Assignee: West Point Foundry & Machine Co., West Point, Ga.

[21] Appl. No.: 589,500

[22] Filed: Mar. 14, 1984

[51] Int. Cl.[3] ..... B65H 49/02; D02H 1/00; D03J 5/08

[52] U.S. Cl. ..... 242/131; 57/352

[58] Field of Search ..... 242/131, 131.1; 57/352–356; 28/193, 190

[56] References Cited

U.S. PATENT DOCUMENTS

| | | | |
|---|---|---|---|
| 1,872,179 | 8/1932 | Peterson | 242/131 |
| 1,886,638 | 11/1932 | Burton | 242/131 |
| 2,534,339 | 12/1950 | Chaya et al. | 242/131 |
| 3,575,359 | 4/1971 | Furst | 242/131 |
| 4,471,917 | 9/1984 | Whisnant | 242/54 R |

FOREIGN PATENT DOCUMENTS

| | | |
|---|---|---|
| 586058 | 9/1933 | Fed. Rep. of Germany . |
| 82237 | 12/1937 | France . |
| 487962 | 6/1938 | United Kingdom . |

*Primary Examiner*—Leonard D. Christian
*Attorney, Agent, or Firm*—Jones & Askew

[57] ABSTRACT

An improved creel assembly for use with strand winding devices such as warpers or the like. The creel has modules supporting yarn packages on both an active side and an inactive side, and also has yarn tensioning devices separately associated with both sides of the modules. The modules and yarn tensioning devices rotate as an entire assembly. Fresh yarn packages thus can be preloaded on the inactive side of the creel, and prethreaded through the tensioning devices associated with the inactive side, before the creel modules are rotated to the active side of the creel. Also disclosed is an improved balloon guard having a yarn opening sufficiently large to accommodate a person's hand for threading yarn through the opening, yet which accomplishes the anti-ballooning function of the balloon guard.

6 Claims, 7 Drawing Figures

CREEL APPARATUS

FIELD OF THE INVENTION

This invention relates in general to yarn warping, and relates in particular to creel apparatus for supporting supplies of yarn or thread withdrawn to a winding machine such as a warper or the like.

BACKGROUND OF THE INVENTION

Warping is the term generally applied to the process of winding many strands of yarn or thread into a sheet-like beam or roll one strand in thickness. Each strand is separately unwound from an individual package of yarn or thread, and the strands pass through a suitable aligning device such as a comb or the like which arranges the strands into a generally flat sheetlike configuration. The strands then pass to a winding device known as a warper, where the strands are wound around a removable core to provide a beam made up of the individual yarns.

The individual packages of yarn conventionally are supported on a creel, which supports the yarn packages while permitting the yarn ends to be withdrawn from the packages by the warper. The creel typically includes a number of separate post or support to hold the corresponding desired number of yarn packages, and also includes separate tensioning devices which engage each individual strand as the strands leave the yarn packages. The tensioning devices, as is known to those skilled in the art, maintain a desired tension on the yarns being pulled by the warper, thereby keeping the yarns taut and preventing tangling during the warping operation.

A creel also typically has a balloon guard associated with each yarn package carried by the creel. The balloon guards of the prior art generally define relatively small eyelet-sized apertures through which the yarn from each package is threaded, before entering the tensioning device associated with the particular yarn package. The relatively narrow eyelet opening of the balloon guard confines the yarn to a relatively small path of travel as withdrawn from the yarn package, thereby preventing the yarn from ballooning outwardly due to centrifugal force as the yarn is pulled from the yarn packages during high-speed warping. Balloon guards for this purpose help prevent yarn entanglement which might otherwise occur during high-speed warping, especially as the diameter of the yarn package diminishes and the yarn consequently uncoils around the package at increasing speeds to maintain a given linear velocity determined by the operating speed of the warper.

When the yarn is fully withdrawn from the yarn packages, the warping operation stops while fresh yarn packages are loaded on the creel. Each individual yarn end must be threaded through the corresponding balloon guard and yarn tensioner, and then carried forwardly through the warper comb and around the fresh empty beam in the warper. This loading and threading operation takes considerable time, inasmuch as a typical creel would support several hundred yarn packages for actively running yarn to the warper.

In an effort to reduce the amount of down time required to reload the creel, creels are known which have two separate regions or sides for supporting yarn packages. The first such side, commonly known as the "active" side, supports yarn packages that are threaded through balloon guards and tensioning devices and are actively supplying yarn to the operating warper. The other or "inactive" side of such creels contains a like number of yarn package supporting elements, and an operator can load fresh packages of yarn on the inactive side while warping takes place by withdrawing the yarns from the previously-threaded active side. When warping is completed from the active side, the creel is rotated or otherwise repositioned to change sides, placing the previously-loaded yarn packages on the active side adjacent the tensioning devices and balloon guards as the expended packages are moved to the inactive side. The operator next rethreads the active side as discussed above, passing each individual yarn through its corresponding balloon guard and tensioning device, before pulling the yarns forward to engage the comb and the warper beam. A new warping operation is then commenced, after which the operator can reload fresh yarn packages onto the inactive side of the creel. With such two-sided creels of the prior art, the tensioning devices and balloon guards generally are supported separately from the yarn package support structure so that the support structure can be moved away from the tension devices to provide ample room for the creel to rotate or otherwise move between its active and inactive sides.

The foregoing two-sided creel arrangement permits fresh yarn packages to be loaded on the inactive side as warping progresses from the active side, and thus represents an improvement in the art. Nevertheless, the creel operator still must perform the time-consuming task of threading the individual yarns through the balloon guards and yarn tensioning devices after the creel is rotated or otherwise moved to place the fresh yarn packages on the active side of the creel. This time spent rethreading the yarns represents nonproductive dead time for the warping operation, and the manual dexterity required for even an experienced operator to thread several hundred yarns through the small balloon guard eyelets and then through the yarn tensioning devices limits the practical extent to which this dead time can be reduced in creels of the prior art.

SUMMARY OF THE INVENTION

Stated in general terms, the novel creel of the present invention has active and inactive sides for supporting yarn packages, and also has yarn tensioning devices separately associated with each side of the creel. These yarn tensioning devices rotate or otherwise move along with the creel, as the creel moves between active and inactive sides, so that a set of yarn tensioning devices remains associated with the inactive side even as yarns are withdrawn from the active side of the creel through the individual tensioning devices associated with that active side. Fresh yarn packages thus can be loaded on the inactive side of the creel, and then threaded through the balloon guards and tensioning devices on the inactive side, as the yarns are withdrawn from the active side by the warper. When the active-side yarns are expended and the warper stops, the creel is moved to transpose the expended yarn packages with the fresh yarn packages previously loaded and threaded on the inactive side. Because these fresh yarn packages already are threaded through the balloon guards and tensioning devices, the operator now merely carries the previously threaded ends forward through the warper comb and around the warp beam, and thereby saves the time previously required to thread the individual yarn ends in creels of the prior art.

Stated somewhat more particularly, the present creels have one or more gates mounted on each side of the creel. These gates support the yarn tensioning devices and balloon guards, and the gates preferably are hinged to swing away from the creel to facilitate loading fresh yarn packages on the inactive side. Once the fresh yarn packages are loaded, the creel gates may then be closed to place the tensioning devices in predetermined juxtaposition adjacent the respective yarn packages. When the creel is later rotated or moved to change between active and inactive positions, the closed gates move along with the creel, presenting the now-threaded yarns to the active side of the creel.

Stated more particularly, creels according to the present invention preferably include a number of modules rotatably mounted in a creel frame assembly. Each module supports a certain number of yarn packages on both its active and inactive sides, and the modules are rotated in unison to transfer between active and inactive sides. Tension-device supporting gates are mounted on both sides of each module, permitting access to load fresh yarn packages on the inactive side of each module.

The novel balloon guard according to the present invention includes a relatively large yarn-guiding opening, large enough for a person to extend his or her entire hand through. The relatively large size of the opening in the present balloon guard, contrasted with the typical eyelet-sized opening in balloon guards of the prior art, greatly facilitates threading the yarn through the guide, and contrary to what might be expect, it has been learned that adequate ballooning control is obtained with the relatively-increased opening of the present balloon guard.

Accordingly, it is an object of the present invention to provide an improved creel apparatus.

It is another object of the present invention to provide a creel which allows fresh yarn packages to be loaded and threaded through tension devices on an inactive side of the creel.

It is another object of the present invention to provide a creel which significantly reduces the down time required to reload the creel between warping operations.

It is yet another object of the present invention to provide an improved balloon guard for use with a creel.

It is still another object of the present invention to provide a balloon guard having relative ease of threading.

The foregoing and other objects and advantages of the present invention will become more readily apparent from the following disclosed embodiment thereof.

DESCRIPTION OF PREFERRED EMBODIMENT

Figure 1:
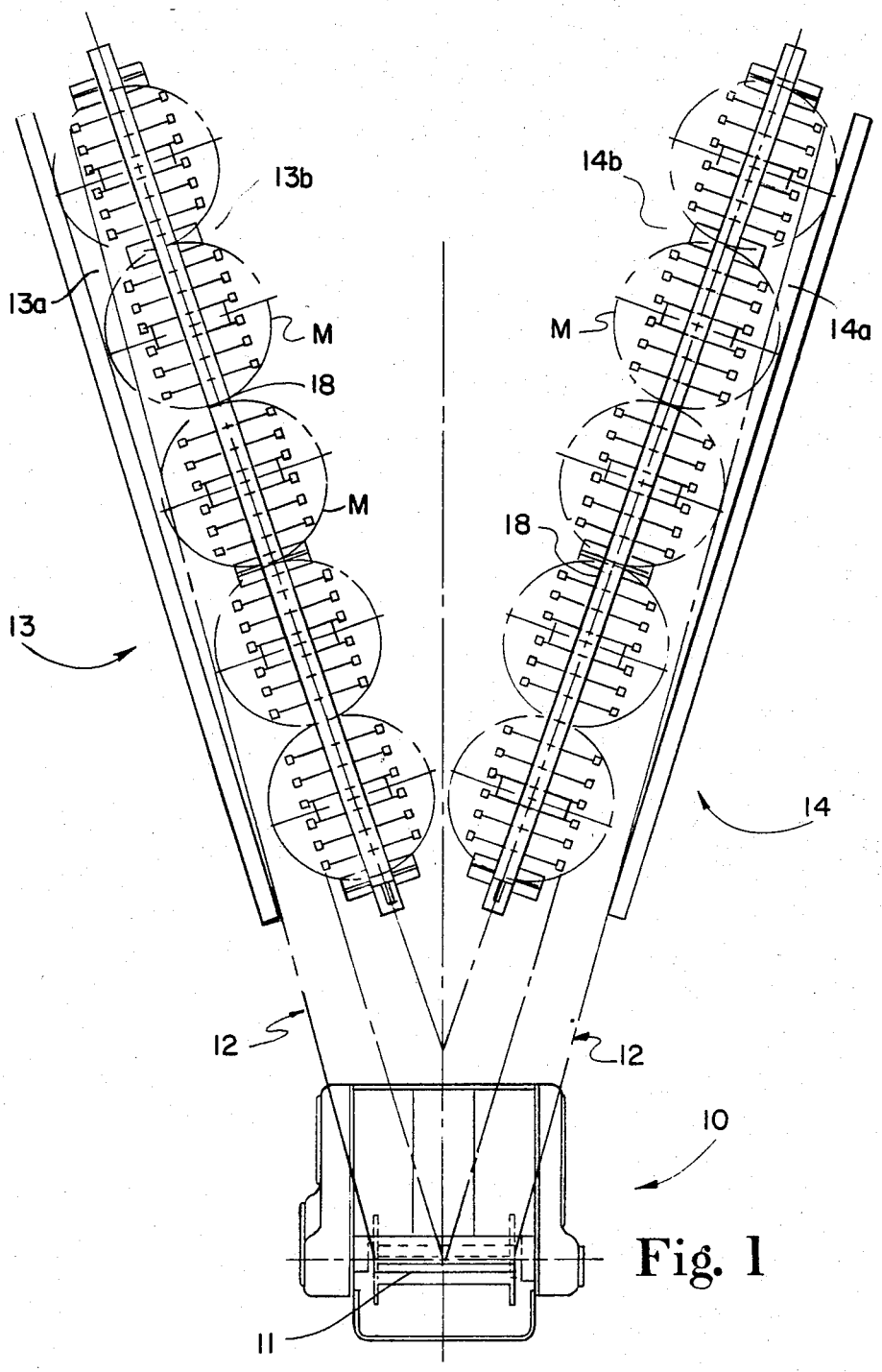
FIG. 1 is a top plan view showing a creel assembly according to a disclosed embodiment of the present invention.

Turning first to FIG. 1, there is shown generally at 10 a warper which may be conventional in construction and operation. The warper 10 includes a comb 11 receiving multiple strands of yarn diagramatically indicated at 12, pulled from the two creel assemblies 13 and 14. These creel assemblies each are mounted at an acute angle relative to the warper 10, and thus define a so-called V-creel configuration, as is known to those skilled in the art. The yarns 12 run to the warper 10 from the outer sides of the V-creel configuration, and these sides **13*a*, 14*a* thus are known as the active sides of the respective creel assemblies. The other sides 13*b*, 14*b* of the creel assemblies, facing each other across the included angle of the V-creel configuration, are the inactive sides of the creels, and can be supplied with fresh yarn packages as the yarns 12 are running off the active sides 13*a*, 14*a* to the warper 10**.

Figure 2:
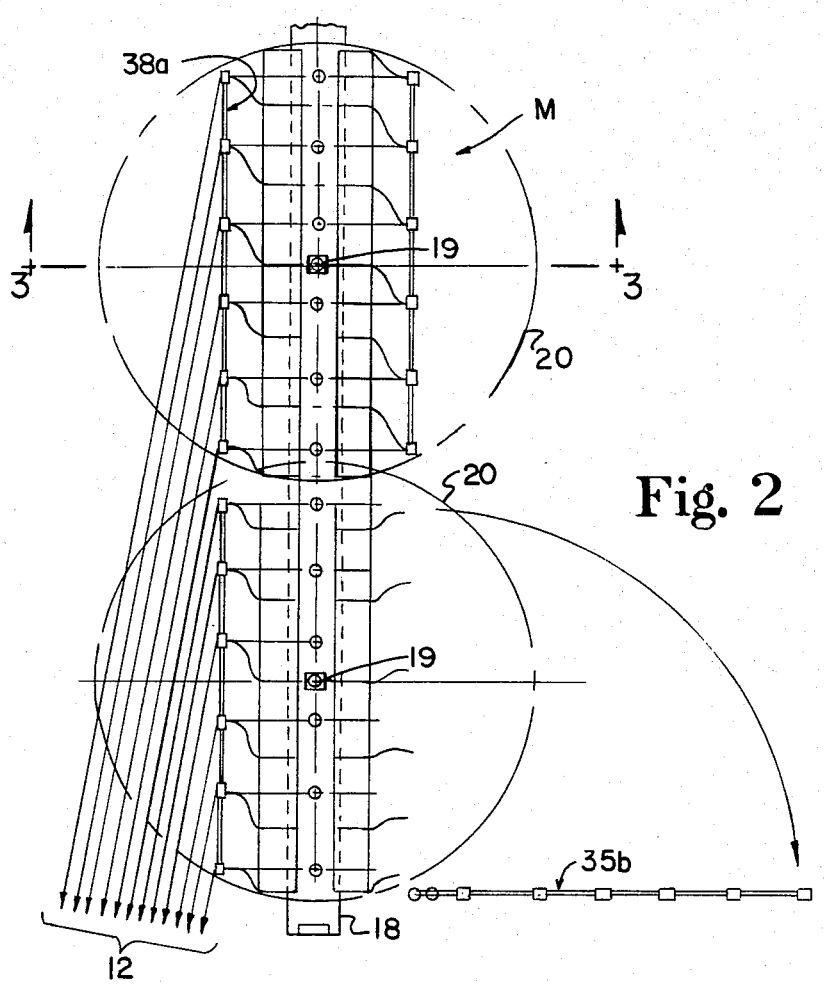
FIG. 2 is a detailed plan view, somewhat fragmentary and schematic in nature, showing two modules on one wing of the creel assembly in FIG. 1.
Figure 5:
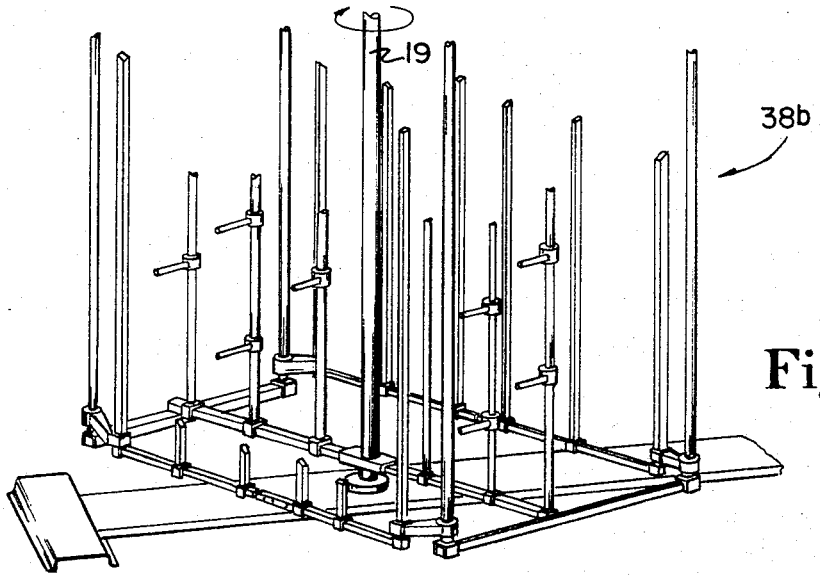
FIG. 5 is an isometric view of the module shown in FIG. 4, with the tension gates closed and the module partially rotated between active and inactive positions.

Each creel assembly 13 and 14 is made up of several creel modules M, and each such module is mounted on the creel frame 18 for rotation about a respective axle 19 (FIG. 2) journalled on the warper frame. A number of such individual modules M typically are supported on the frame 18 of each creel assembly 13, 14, as best seen in FIGS. 1 and 2, and adjacent modules are spaced and configured to permit the modules to undergo a complete circular rotation as indicated by the circular pass 20.

Figure 2A:
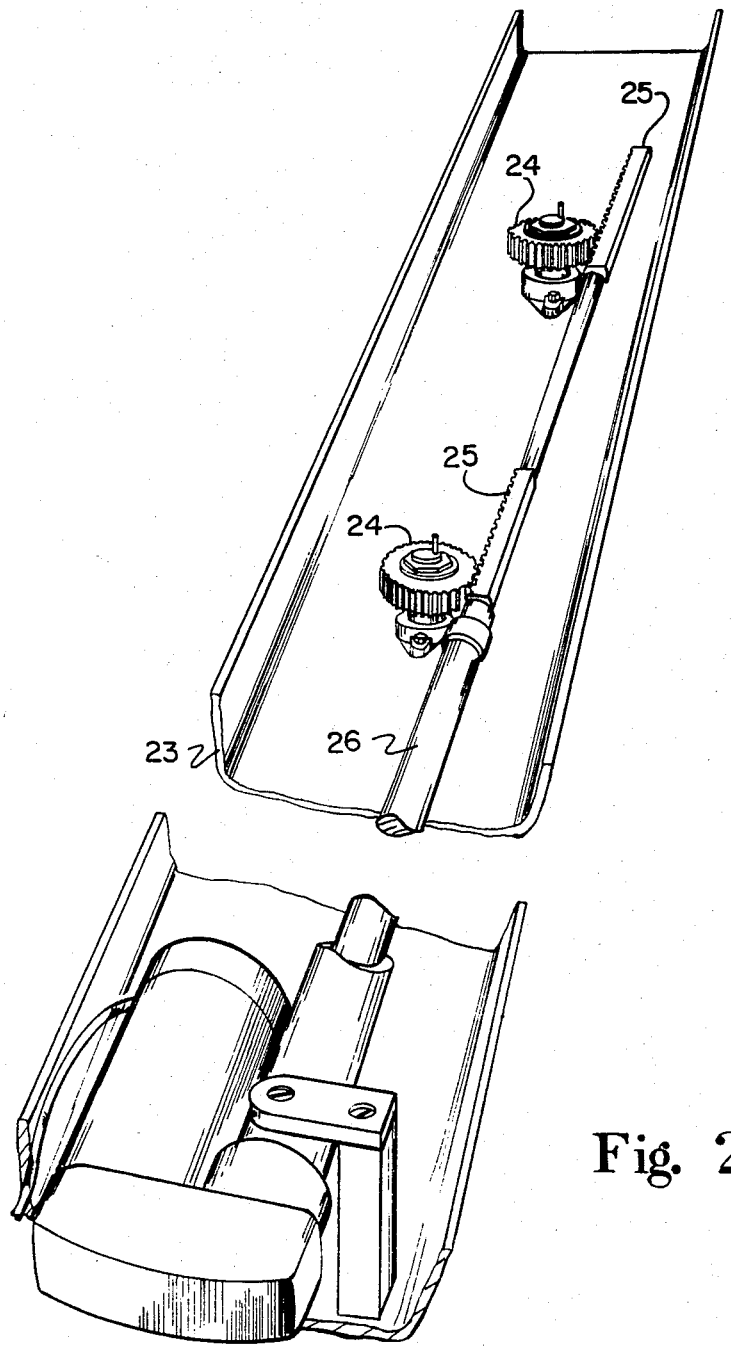
FIG. 2A is a fragmentary isometric view showing the module rotating mechanism of the disclosed embodiment.

All the modules M for each separate creel assembly 13 or 14 preferably are connected for rotation in unison, and one such arrangement for accomplishing this rotation is shown in FIG. 2A. The uppe end of each module axle 19 extends upwardly through the top frame member 23 of the creel assembly frame, and supports a pinion 24. Each pinion 24 is engaged by a corresponding separate rack gear 25, and the rack gears are mechanically interconnected for reversible movement in unison relative to their respective pinions 24. The rack gears, in turn, are mechanically coupled to a linear actuator 26 which is powered by any suitable device such as a bidirectional electric motor or the like. As the linear actuator selectably operates in either direction, it will be seen that the rack gears 25 drive the respective pinions 24 to rotate the modules M of all creel assemblies in unison.

Figure 3:
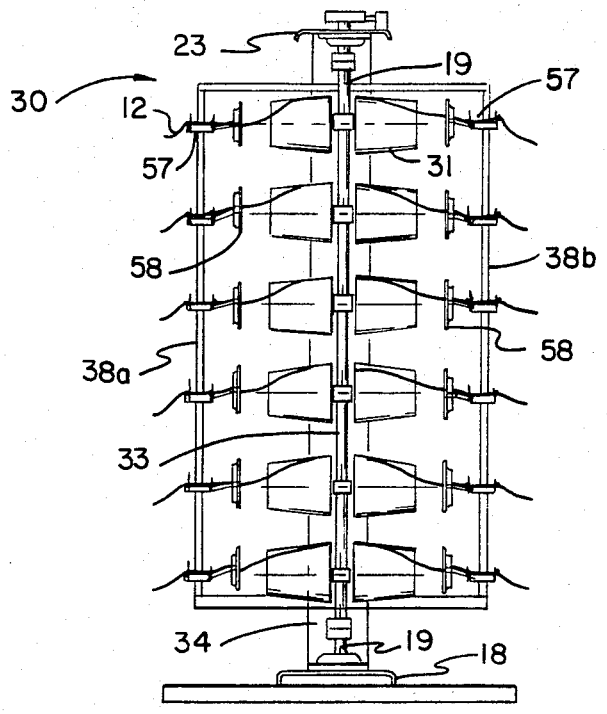
FIG. 3 is an end elevation view taken from one end of FIG. 2.

Turning to FIG. 3, a typical module M shown at 30 has a first side **30*a* and a second side 30*b*. It should now be apparent that either the first side 30*a* or the second side 30*b* can be the active side 13*a* or 14*a*, FIG. 1, from which the yarns 12 presently are drawn by the warper, and the inactive sides 13*b* or 14*b* is the module side presently facing the interior of the V-creel configuration as mentioned above. It should also now be understood that upon rotating the particular creel module 30 as described above, the sides 30*a* and 30*b* change places; the side 30*a* or 30*b* previously on the inactive side then moves to the active side of the creel assembly, being the side 30*a* depicted in FIG. 3, while the other side 30*b*** moves to the inactive or right side of the creel assembly shown in that figure.

Figure 4:
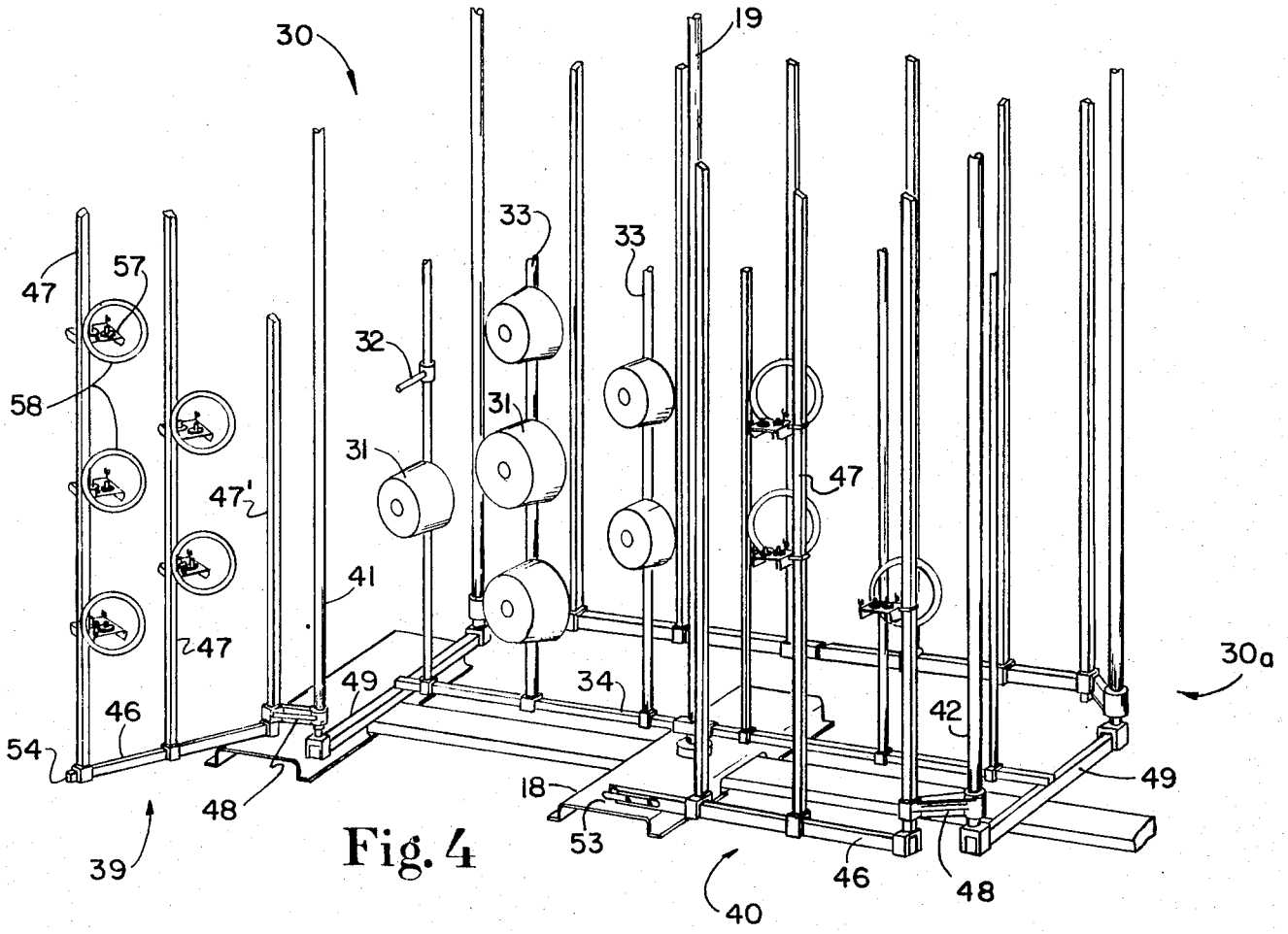
FIG. 4 is a more detailed side elevation view taken from one side of FIG. 2 and showing a single module of the creel assembly.

The two sides 30*a* and 30*b* of each creel module are equipped to support a number of yarn packages 31, FIGS. 3 and 4, and each such yarn package is supported on a separate package post 32 extending outwardly from one of a number of upright supports 33 forming part of each rotary module. As best seen in FIG. 4, each rotary module includes a number of upright supports 33 extending between a longitudinal lower frame member 34 and a corresponding upper frame member (not shown) attached to the module axle 19 for rotation therewith. Each upright support 33 holds an equal number of yarn package posts 32 on both sides 30*a*, 30*b* of the module 30, thereby providing support for the fresh yarn packages being loaded on the inactive module side 30*b* as yarns 12 currently are running from active yarn packages on the module side 30*a* facing the active side of the creel.

Mounted on the sides 30*a*, 30*b* of the creel module 30 are corresponding separate gate assemblies 38*a*, 38*b* shown somewhat schematically in FIG. 2. As shown in detail in FIG. 4, each gate assembly 38*a*, 38*b* in the disclosed embodiment comprises a pair of separate gates 39 and 40 hinged from upright posts 41, 42 at the ends of the creel module 30 to open like barn doors, so that all package posts 32 on a side of the module are exposed for loading fresh yarn packages when the gates 30 and 40 are swung open, as shown by the gate 39 in FIG. 4.

Each gate 39, 40 includes a horizontal lower rail 46 and a companion upper rail (not shown) and a number of upright posts 47 supported between lower and upper rails. At the ends of the post 47' nearest the respective posts 41, 42 of the creel module 30, short standoff links 48 pivotably extend between the gate posts 47' and the adjacent module posts 41, 42. The posts 41, 42 are mounted on respective transverse rails 49 at the opposite ends of the longitudinal frame member 34, thereby displacing the gates 38*a*, 38*b* a distance outwardly from the yarn package posts 32 on the respective sides 30*a*, 30*b* of the creel module 30. A latching mechanism 53 is disposed on the free end of the lower rail 46 on the gate 40 to engage the confronting end 54 of the lower rail 46 on the gate 39, when the two gates are moved to the closed position.

It should be noted that in FIG. 2, the gate assembly 38*b* is schematically shown as a one-piece gate which hinges from one end of the creel module M, instead of being individual gates which opens barn door-fashion as in FIG. 4. While the gate arrangement is schematically shown in FIG. 2 only to illustrate the basic function of the gates, it should be understood that single-element gate assemblies opening at an end of the creel module can in actual practice be substituted for the gates mounted to open like barn doors, as shown in FIG. 4 and as utilized on the preferred embodiment of the present invention.

Figure 6:
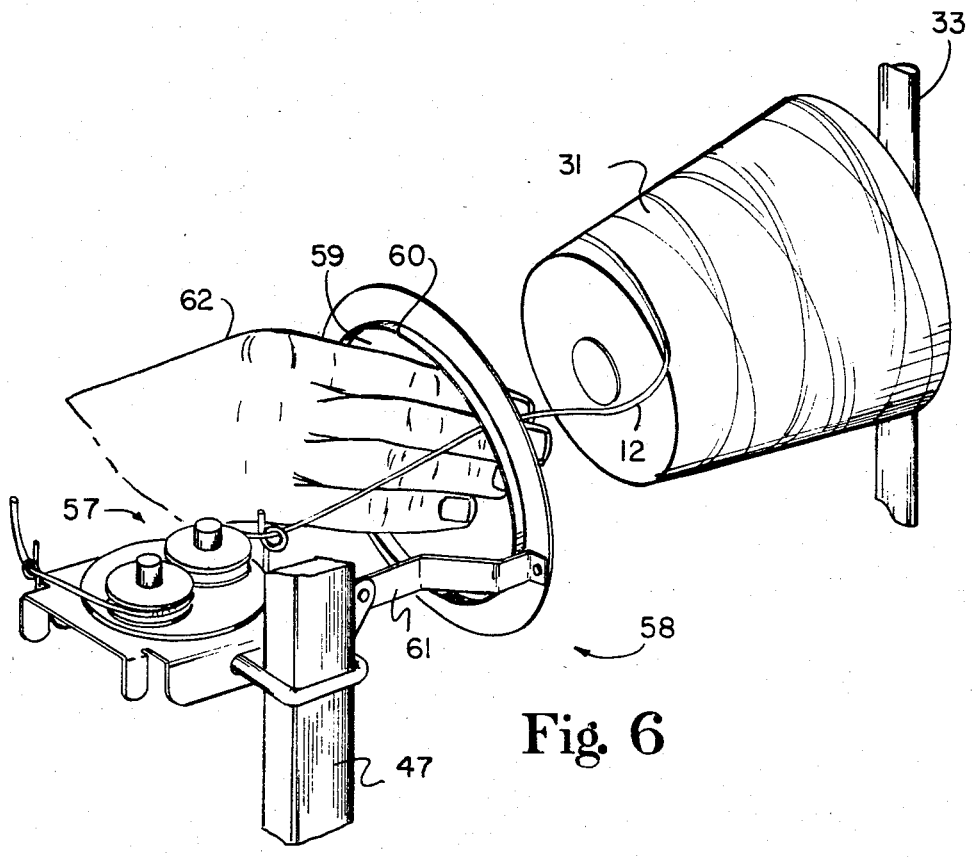
FIG. 6 is a detailed pictorial view showing a balloon restrictor according to a disclosed embodiment of the present invention.

Each vertical post 47 on the gates 39 and 40 supports a number of yarn tensioning devices 57 and corresponding balloon guards 58, best seen in FIG. 6. Each tensioning device 57 and associated balloon guard 58 is mounted on a corresponding post 47 such that a tensioning device and balloon guard are positioned in predetermined juxtaposition with the yarn package 31 carried by a selected package post 32, when the gates 39 and 40 are closed.

The yarn tensioning devices in the disclosed embodiment are of conventional construction and operation, and are not further discussed herein. The balloon guards 58, however, are novel in construction, having a relatively large opening 59 defined by an annular ring member 60. The balloon guard 58 is supported by a bracket 61 extending inwardly from the post 47 to engage the ring member 60. As shown in FIG. 6, the opening 59 in the balloon guard 58 is large enough to accommodate the hand 62 of the person threading the tension device, enabling this person to reach through the balloon guard and easily grasp the yarn 12 extending from the freshly-loaded yarn package 31. The person can then easily pull the yarn 12 through the opening 59 in the balloon guard, and draw the yarn through the balloon guard for threading in the tensioning device 57. In contrast, balloon guards of the prior art utilized a relatively small eyelet in place of the relatively large opening 59, requiring two hands to thread the yarn 12 through the eyelet.

The creel apparatus is operated in the following manner, with initial reference made to FIG. 1. Assuming the warper 10 presently is operating to draw yarns 12 from the active sides 13*a*, 14*a* of the two creel assemblies making up the V-creel arrangement, the operator can load fresh yarn packages onto the inactive sides 13*b*, 14*b* of the creel assemblies. This is a accomplished by first opening the gates associated with each creel module M on its inactive side; the typical creel module 30 in FIG. 4 shows one gate 39 open in this fashion. The opened gates allow free access to the package posts 32, permitting fresh yarn packages 31 to be loaded onto those posts.

After each post 32 on the inactive side 30*b* of the module receives a fresh yarn package 31, the gates 39 and 40 are closed and latched. The tensioning devices 57 and balloon guards 58 thereby are positioned in front of each fresh yarn package 31, allowing the operator to extend his or her hand 62 through the balloon guard opening 59 and draw the ends of the yarns 12 through the balloon guard for threading on the respective tension devices 57. All the tension devices 57 on the inactive side of each module are thus preheated while the warper continues to draw yarns from the yarn packages on the opposite active sides of the creel.

When the yarn packages are expended on the active sides 13*a*, 14*a* of the creel assembly, the warper stops and the operator cuts all yarns near the tensioning devices in the conventional fashion. The operator then actuates a suitable control to rotate the modules M of each creel assembly 13, 14 in unison, placing the previously-loaded and previously-threaded sides of the modules on the active sides of the creel assembly. The operator now carries the previously-threaded yarn ends forwardly from the tensioning devices, threading these ends through the warper comb 11 and onto a fresh beam on the warper 10. The warper is then started and production resumed. The operator may now open the gates recently repositioned to the inactive sides 13*b*, 14*b* of the creel assemblies 13 and 14, so as to repeat the loading and threading operation on these inactive sides.

It will thus be seen that the present creel apparatus includes tensioning devices separately associated with both sides of a creel, allowing yarn packages to be loaded on the inactive side and threaded in the tension devices separately associated with that side, before moving the inactive side into active position with respect to the warper. Because the entire package frame assembly including the yarn package posts and yarn packages, together with tensioning devices, rotates with the creel modules, the yarns can be preloaded and preheated through the tensioning devices before moved to the active side of the creel. This arrangement substantially reduced the amount of operator time and warper down time required before warping production is resumed.

It should be understood that the foregoing refers only to a disclosed embodiment of the present invention, and that numerous modifications and changes may be made therein without departing from the spirit and scope of the invention as defined in the following claims.

I claim:

1. Creel apparatus for supporting a plurality of yarn packages feeding yarns to a yarn receiving apparatus such as a warper or the like, comprising in combination:

support means for mounting in predetermined relation to a yarn receiving apparatus;

frame means having first and second yarn package supporting sides, and having means mounting said support means for rotation between first and second positions respectively placing either of said sides in active yarn feeding relation to the yarn receiving apparatus while the other side is in an inactive relation thereto;

a first plurality of yarn tensioning means associated with the first side of said frame means and operative to engage the yarns from the yarn packages received on said first side;

a second plurality of yarn tensioning means associated with the second side of said frame means and operative to engage the yarns from the yarn packages received on said second side; and said first and second pluralities of yarn tensioning means mounted for movement with said frame means as the frame means rotates between said first and second positions, so that the yarns from the yarn packages on the said side positioned in inactive relation to the yarn receiving apparatus can be threaded to engage said tensioning means associated with that inactive side while yarns from the yarn packages on the other said side positioned in active relation to the yarn receiving apparatus are being drawn from said active side by that apparatus, whereby said frame means including said tension means can be rotated to reposition the previously-threaded inactive side into the active yarn feeding relation to the yarn receiving apparatus as the previously-active side is repositioned to inactive relation ready for loading and threading a fresh supply of yarn packages.

2. Creel apparatus as in claim 1, further comprising:

first and second gate means respectively associated with said first and second sides of said frame means;

said first plurality of yarn tensioning means being mounted on said first gate means in predetermined relation to the yarn packages supported on said first side of the frame means; and said second plurality of yarn tensioning means being mounted on said second gate means in predetermined relation to the yarn packages supported on said second side of the frame means.

3. Creel apparatus as in claim 2, wherein said first and second gate means are mounted for independent movement away from the respective sides of said frame means, so as to withdraw the yarn tensioning means and permit loading fresh yarn packages on the inactive side of said frame means.

4. Creel apparatus as in claim 1, further comprising:

a first plurality of yarn package mounting means mounted on the first side of said frame means;

a second plurality of yarn package mounting means mounted on the second side of said frame means;

first and second gate means respectively mounted on said first and second sides of the frame means;

said first plurality of yarn tensioning means being mounted on said first gate means in predetermined relation to said first plurality of yarn package mounting means;

said second plurality of yarn tensioning means being mounted on said second gate means in predetermined relation to said second plurality of yarn package mounting means;

each of said gate means being mounted for selectable movement with respect to the corresponding side of said frame means so as to withdraw the yarn tensioning means to permit loading fresh yarn packages on said yarn package mounting means; and both of said gate means being mounted for movement with said frame means when the frame means moves is rotated relative to said support means.

5. Creel apparatus as in claim 4, further comprising:

hinge means connecting each said gate means to said frame means and operating to enable the gate means to selectably retract from the respective yarn package supporting sides, so that said yarn tensioning means thereby are withdrawn to permit loading said yarn package mounting means.

6. Creel apparatus as in claim 3, further comprising:

a balloon guard disposed between each yarn tensioning means in confronting alignment with the corresponding yarn package, each such balloon guard being disposed on the respective gate means to be withdrawn from the yarn packages as said gate means are moved away from the sides of said frame means;

each said balloon guard having a peripheral surface defining an opening through which the yarn from a yarn package is drawn by the yarn receiving apparatus at speed sufficient to cause ballooning as the yarn unwinds circularly from the yarn package, so that said ballooning yarn travels around said peripheral surface thereby to limit the maximum extent of ballooning; and said openings of the balloon guards being large enough to receive a person's hand for threading the yarn from the yarn package through the balloon guard opening to the corresponding yarn tensioning means, thereby simplifying the threading of the yarn.

* * * * *